US008033616B2

(12) United States Patent
Hall et al.

(10) Patent No.: US 8,033,616 B2
(45) Date of Patent: Oct. 11, 2011

(54) BRAZE THICKNESS CONTROL

(75) Inventors: David R. Hall, Provo, UT (US); Jacob D. Smith, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 292 days.

(21) Appl. No.: 12/200,786

(22) Filed: Aug. 28, 2008

(65) Prior Publication Data

US 2008/0309149 A1 Dec. 18, 2008

Related U.S. Application Data

(63) Continuation-in-part of application No. 12/177,556, filed on Jul. 22, 2008, now Pat. No. 7,635,168, which is a continuation-in-part of application No. 12/135,595, filed on Jun. 9, 2008, which is a continuation-in-part of application No. 12/112,743, filed on Apr. 30, 2008, which is a continuation-in-part of application No. 12/051,738, filed on Mar. 19, 2008, now Pat. No. 7,669,674, which is a continuation-in-part of application No. 12/051,689, filed on Mar. 19, 2008, which is a continuation of application No. 12/051,586, filed on Mar. 19, 2008, which is a continuation-in-part of application No. 12/021,051, filed on Jan. 28, 2008, which is a continuation-in-part of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, (Continued)

(51) Int. Cl.
*E21C 35/183* (2006.01)

(52) U.S. Cl. ..... 299/113

(58) Field of Classification Search ..... 299/104–107, 299/110, 111, 113
See application file for complete search history.

(56) References Cited

U.S. PATENT DOCUMENTS 1,899,343 A 2/1933 William (Continued)

FOREIGN PATENT DOCUMENTS

DE 3500261 7/1986

(Continued)

*Primary Examiner* — John Kreck
(74) *Attorney, Agent, or Firm* — Brinks Hofer Gilson & Lione

(57) ABSTRACT

A degradation tool or assembly comprises an inverted conical face formed in a top end of a tool body, which top face tapers towards a central axis of the tool body. A base end of a carbide bolster is adapted to be brazed to the inverted conical top face. At least one protrusion is formed in the top face and is adapted to control a braze thickness between the top face of the tool body and the base end of the carbide bolster.

20 Claims, 12 Drawing Sheets

Related U.S. Application Data now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 12/200,786, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(56) References Cited

U.S. PATENT DOCUMENTS

| | | | | |
|---|---|---|---|---|
| 2,004,315 | A | | 6/1935 | Fean |
| 2,124,438 | A | | 7/1938 | Struk et al. |
| 3,254,392 | A | | 6/1966 | Novkov |
| 3,342,531 | A | | 9/1967 | Krekeler |
| 3,342,532 | A | | 9/1967 | Krekeler |
| 3,397,012 | A | | 8/1968 | Krekeler |
| 3,512,838 | A | | 5/1970 | Kniff |
| 3,650,565 | A | | 3/1972 | Kniff |
| 3,655,244 | A | | 4/1972 | Swisher |
| 3,746,396 | A | | 7/1973 | Radd |
| 3,767,266 | A | | 10/1973 | Krekeler |
| 3,778,112 | A | | 12/1973 | Krekeler |
| 3,807,804 | A | | 4/1974 | Kniff |
| 3,820,848 | A | | 6/1974 | Kniff |
| 3,830,321 | A | | 8/1974 | McKenry |
| 3,932,952 | A | | 1/1976 | Helton |
| 3,942,838 | A | | 3/1976 | Bailey et al. |
| 3,945,681 | A | | 3/1976 | White |
| 3,957,307 | A | | 5/1976 | Varda |
| 4,005,914 | A | | 2/1977 | Newman |
| 4,006,936 | A | | 2/1977 | Crabiel |
| 4,098,362 | A | | 7/1978 | Bonnice |
| 4,109,737 | A | | 8/1978 | Bovenkerk |
| RE29,900 | E | | 2/1979 | Kniff |
| 4,149,753 | A | | 4/1979 | Stoltz et al. |
| 4,156,329 | A | | 5/1979 | Daniels |
| 4,199,035 | A | | 4/1980 | Thompson |
| 4,201,421 | A | | 5/1980 | Den Besten |
| 4,247,150 | A | | 1/1981 | Wrulich et al. |
| 4,268,089 | A | | 5/1981 | Spence et al. |
| 4,277,106 | A | | 7/1981 | Sahley |
| 4,397,362 | A | | 8/1983 | Dice et al. |
| 4,439,250 | A | | 3/1984 | Acharya |
| 4,465,221 | A | | 8/1984 | Schmidt |
| 4,484,644 | A | | 11/1984 | Cook |
| 4,484,783 | A | | 11/1984 | Emmerich |
| 4,489,986 | A | | 12/1984 | Dziak |
| 4,497,520 | A | | 2/1985 | Ojanen |
| 4,537,448 | A | | 8/1985 | Ketterer |
| 4,583,786 | A | | 4/1986 | Thorpe et al. |
| 4,647,111 | A | | 3/1987 | Bronder |
| 4,657,308 | A | | 4/1987 | Clapham |
| 4,660,890 | A | | 4/1987 | Mills |
| 4,669,786 | A | | 6/1987 | Morgan |
| 4,678,237 | A | | 7/1987 | Collin |
| 4,682,987 | A | | 7/1987 | Brady |
| 4,684,176 | A | | 8/1987 | Den Besten |
| 4,688,856 | A | | 8/1987 | Elfgen |
| 4,702,525 | A | | 10/1987 | Sollami |
| 4,720,199 | A | | 1/1988 | Geczy et al. |
| 4,725,098 | A | | 2/1988 | Beach |
| 4,728,153 | A | | 3/1988 | Ojanen et al. |
| 4,729,603 | A | | 3/1988 | Elfgen |
| 4,746,379 | A | | 5/1988 | Rabinkin |
| 4,765,686 | A | | 8/1988 | Adams |
| 4,765,687 | A | | 8/1988 | Parrott |
| 4,776,862 | A | | 10/1988 | Wiand |
| 4,804,231 | A | | 2/1989 | Buljan et al. |
| 4,811,801 | A | | 3/1989 | Salesky et al. |
| 4,836,614 | A | | 6/1989 | Ojanen |
| 4,850,649 | A | | 7/1989 | Beach et al. |
| 4,880,154 | A | | 11/1989 | Tank |
| 4,880,247 | A | | 11/1989 | Herridge |
| 4,893,875 | A | | 1/1990 | Lonn |
| 4,911,503 | A | | 3/1990 | Stiffler |
| 4,911,504 | A | | 3/1990 | Stiffler |
| 4,921,310 | A | | 5/1990 | Hedlund et al. |
| D308,683 | S | | 6/1990 | Meyers |
| 4,932,723 | A | | 6/1990 | Mills |
| 4,934,467 | A | | 6/1990 | Langford |
| 4,940,288 | A | | 7/1990 | Stiffler |
| 4,941,711 | A | * | 7/1990 | Stiffler ..... 299/113 |
| 4,944,559 | A | | 7/1990 | Sionnet |
| 4,951,762 | A | | 8/1990 | Lundell |
| RE33,494 | E | | 12/1990 | Hindmarsh et al. |
| 4,981,328 | A | | 1/1991 | Stiffler |
| 5,007,685 | A | | 4/1991 | Beach et al. |
| 5,011,515 | A | | 4/1991 | Frushour |
| 5,018,793 | A | | 5/1991 | Den Besten |
| 5,054,217 | A | * | 10/1991 | Nilsson et al. ..... 37/244 |
| 5,074,623 | A | * | 12/1991 | Hedlund et al. ..... 299/111 |
| 5,112,165 | A | | 5/1992 | Hedlund |
| 5,141,289 | A | | 8/1992 | Stiffler |
| 5,154,245 | A | | 10/1992 | Waldenstrom |
| 5,186,892 | A | | 2/1993 | Pope |
| 5,251,964 | A | | 10/1993 | Ojanen |
| 5,261,499 | A | | 11/1993 | Grubb |
| 5,303,984 | A | | 4/1994 | Ojanen |
| 5,332,348 | A | | 7/1994 | Lemelson |
| 5,374,111 | A | | 12/1994 | Den Besten |
| 5,415,462 | A | | 5/1995 | Massa |
| 5,417,475 | A | | 5/1995 | Graham |
| 5,447,208 | A | | 9/1995 | Lund |
| 5,503,463 | A | | 4/1996 | Ojanen |
| 5,535,839 | A | | 7/1996 | Brady |
| 5,542,993 | A | | 8/1996 | Rabinkin |
| 5,653,300 | A | | 8/1997 | Lund |
| 5,702,160 | A | * | 12/1997 | Levankovskii et al. ..... 299/111 |
| 5,720,528 | A | | 2/1998 | Ritchey |
| 5,725,283 | A | | 3/1998 | O'Neill |
| 5,730,502 | A | | 3/1998 | Montgomery |
| 5,738,698 | A | | 4/1998 | Kapoor |
| 5,823,632 | A | | 10/1998 | Burkett |
| 5,837,071 | A | | 11/1998 | Anderson |
| 5,842,747 | A | | 12/1998 | Winchester |
| 5,845,547 | A | | 12/1998 | Sollami |
| 5,875,862 | A | | 3/1999 | Jurewicz |
| 5,884,979 | A | | 3/1999 | Latham |
| 5,890,552 | A | | 4/1999 | Scott et al. |
| 5,934,542 | A | | 8/1999 | Nakamura |
| 5,935,718 | A | | 8/1999 | Demo |
| 5,944,129 | A | | 8/1999 | Jenson |
| 5,967,250 | A | | 10/1999 | Lund |
| 5,992,405 | A | | 11/1999 | Sollami |
| 6,006,846 | A | | 12/1999 | Tibbitts |
| 6,019,434 | A | | 2/2000 | Emmerich |
| 6,044,920 | A | | 4/2000 | Massa et al. |
| 6,051,079 | A | | 4/2000 | Andersson |
| 6,056,911 | A | | 5/2000 | Griffin |
| 6,065,552 | A | | 5/2000 | Scott |
| 6,109,377 | A | | 8/2000 | Massa et al. |
| 6,113,195 | A | | 9/2000 | Mercier |
| 6,170,917 | B1 | | 1/2001 | Heinrich |
| 6,193,770 | B1 | | 2/2001 | Sung |
| 6,196,636 | B1 | | 3/2001 | Mills |
| 6,196,910 | B1 | | 3/2001 | Johnson |
| 6,199,956 | B1 | | 3/2001 | Kammerer |
| 6,216,805 | B1 | | 4/2001 | Lays |

| | | | |
|---|---|---|---|
| 6,270,165 | B1 | 8/2001 | Peay |
| 6,341,823 | B1 | 1/2002 | Sollami |
| 6,354,771 | B1 | 3/2002 | Bauschulte |
| 6,357,832 | B1 | 3/2002 | Sollami |
| 6,364,420 | B1 | 4/2002 | Sollami |
| 6,371,567 | B1 | 4/2002 | Sollami |
| 6,375,272 | B1 | 4/2002 | Ojanen |
| 6,419,278 | B1 | 7/2002 | Cunningham |
| 6,478,383 | B1 | 11/2002 | Ojanen |
| 6,481,803 | B2 | 11/2002 | Ritchey |
| 6,499,547 | B2 | 12/2002 | Scott |
| 6,508,516 | B1 | 1/2003 | Kammerer |
| 6,517,902 | B2 | 2/2003 | Drake |
| RE38,151 | E | 6/2003 | Penkunas et al. |
| 6,585,326 | B2 | 7/2003 | Sollami |
| 6,644,755 | B1 | 11/2003 | Kammerer |
| 6,685,273 | B1 | 2/2004 | Sollami |
| 6,692,083 | B2 | 2/2004 | Latham |
| 6,702,393 | B2 | 3/2004 | Mercier |
| 6,709,065 | B2 | 3/2004 | Peay |
| 6,719,074 | B2 | 4/2004 | Tsuda |
| 6,732,914 | B2 | 5/2004 | Cadden et al. |
| 6,733,087 | B2 | 5/2004 | Hall |
| 6,739,327 | B2 | 5/2004 | Sollami |
| 6,758,530 | B2 | 7/2004 | Sollami |
| 6,786,557 | B2 | 9/2004 | Montgomery, Jr. |
| 6,824,225 | B2 | 11/2004 | Stiffler |
| 6,846,045 | B2 | 1/2005 | Sollami |
| 6,851,758 | B2 | 2/2005 | Beach |
| 6,854,810 | B2 | 2/2005 | Montgomery, Jr. |
| 6,861,137 | B2 | 3/2005 | Griffin et al. |
| 6,880,744 | B2 | 4/2005 | Noro et al. |
| 6,889,890 | B2 | 5/2005 | Yamazaki |
| 6,938,961 | B2 | 9/2005 | Broom |
| 6,962,395 | B2 | 11/2005 | Mouthaan |
| 6,966,611 | B1 | 11/2005 | Sollami |
| 6,994,404 | B1 | 2/2006 | Sollami |
| 7,097,258 | B2 | 8/2006 | Sollami |
| 7,118,181 | B2 | 10/2006 | Frear |
| 7,204,560 | B2 | 4/2007 | Mercier |
| 7,234,782 | B2 | 6/2007 | Stehney |
| 7,384,105 | B2 | 6/2008 | Hall et al. |
| 7,387,345 | B2 | 6/2008 | Hall et al. |
| 7,390,066 | B2 | 6/2008 | Hall et al. |
| 7,413,258 | B2 | 8/2008 | Hall et al. |
| 2002/0070602 | A1 | 6/2002 | Sollami |
| 2002/0074851 | A1 | 6/2002 | Montgomery, Jr. |
| 2002/0153175 | A1 | 10/2002 | Ojanen |
| 2002/0175555 | A1 | 11/2002 | Mercier |
| 2003/0047985 | A1 | 3/2003 | Stiffler |
| 2003/0137185 | A1 | 7/2003 | Sollami |
| 2003/0140360 | A1 | 7/2003 | Mansuy et al. |
| 2003/0141350 | A1 | 7/2003 | Noro et al. |
| 2003/0141753 | A1 | 7/2003 | Peay et al. |
| 2003/0209366 | A1* | 11/2003 | McAlvain ..... 175/427 |
| 2003/0230926 | A1 | 12/2003 | Mondy et al. |
| 2003/0234280 | A1 | 12/2003 | Cadden |
| 2004/0026132 | A1 | 2/2004 | Hall et al. |
| 2004/0026983 | A1 | 2/2004 | McAlvain |
| 2004/0065484 | A1 | 4/2004 | McAlvain |
| 2005/0044987 | A1 | 3/2005 | Takayama et al. |
| 2005/0159840 | A1 | 7/2005 | Lin |
| 2005/0173966 | A1 | 8/2005 | Mouthaan |
| 2006/0125306 | A1 | 6/2006 | Sollami |
| 2006/0237236 | A1 | 10/2006 | Sreshta |
| 2008/0084106 | A1 | 4/2008 | Marathe et al. |

FOREIGN PATENT DOCUMENTS

| | | |
|---|---|---|
| DE | 3818213 | 11/1989 |
| DE | 4039217 | 6/1992 |
| DE | 19821147 | 11/1999 |
| DE | 10163717 | 5/2003 |
| EP | 0295151 | 6/1988 |
| EP | 0412287 | 7/1990 |
| EP | 1574309 | 9/2005 |
| GB | 2004315 | 3/1979 |
| GB | 2037223 | 11/1979 |
| JP | 5280273 | 10/1993 |

* cited by examiner

BRAZE THICKNESS CONTROL

CROSS REFERENCE TO RELATED APPLICATIONS

This application is a continuation-in-part of U.S. patent application Ser. No. 12/177,556, filed on Jul. 22, 2008, which is a continuation-in-part of U.S. patent application Ser. No. 12/135,595, filed on Jun. 9, 2008, which is a continuation-in-part of U.S. patent application Ser. No. 12/112,743, filed on Apr. 30, 2008, which is a continuation-in-part of U.S. patent application Ser. No. 12/051,738, filed on Mar. 19, 2008, now U.S. Pat. No. 7,669,674, which is a continuation-in-part of U.S. patent application Ser. No. 12/051,689, filed on Mar. 19, 2008, which is a continuation of U.S. patent application Ser. No. 12/051,586, filed on Mar. 19, 2008, which is a continuation-in-part of U.S. patent application Ser. No. 12/021,051, filed on Jan. 28, 2008, which is a continuation-in-part of U.S. patent application Ser. No. 12/021,019, filed on Jan. 28, 2008, which was a continuation-in-part of U.S. patent application Ser. No. 11/971,965, filed on Jan. 10, 2008, now U.S. Pat. No. 7,648,210, which is a continuation of U.S. patent application Ser. No. 11/947,644, filed on Nov. 29, 2007, which was a continuation-in-part of U.S. patent application Ser. No. 11/844,586, filed on Aug. 24, 2007, now U.S. Pat. No. 7,600,823. U.S. patent application Ser. No. 11/844,586 is a continuation-in-part of U.S. patent application Ser. No. 11/829,761, filed on Jul. 27, 2007, now U.S. Pat. No. 7,722,127. U.S. patent application Ser. No. 11/829,761 is a continuation-in-part of U.S. patent application Ser. No. 11/773,271, filed on Jul. 3, 2007. U.S. patent application Ser. No. 11/773,271 is a continuation-in-part of U.S. patent application Ser. No. 11/766,903, filed on Jun. 22, 2007. U.S. patent application Ser. No. 11/766,903 is a continuation of U.S. patent application Ser. No. 11/766,865, filed on Jun. 22, 2007. U.S. patent application Ser. No. 11/766,865 is a continuation-in-part of U.S. patent application Ser. No. 11/742,304, filed on Apr. 30, 2007, now U.S. Pat. No. 7,475,948. U.S. patent application Ser. No. 11/742,304 is a continuation of U.S. patent application Ser. No. 11/742,261, filed on Apr. 30, 2007, now U.S. Pat. No. 7,469,971. U.S. patent application Ser. No. 11/742,261 is a continuation-in-part of U.S. patent application Ser. No. 11/464,008, filed on Aug. 11, 2006, now U.S. Pat. No. 7,338,135. U.S. patent application Ser. No. 11/464,008 is a continuation-in-part of U.S. patent application Ser. No. 11/463,998, filed on Aug. 11, 2006, now U.S. Pat. No. 7,384,105. U.S. patent application Ser. No. 11/463,998 is a continuation-in-part of U.S. patent application Ser. No. 11/463,990, filed on Aug. 11, 2006, now U.S. Pat. No. 7,320,505. U.S. patent application Ser. No. 11/463,990 is a continuation-in-part of U.S. patent application Ser. No. 11/463,975, filed on Aug. 11, 2006, now U.S. Pat. No. 7,445,294. U.S. patent application Ser. No. 11/463,975 is a continuation-in-part of U.S. patent application Ser. No. 11/463,962, filed on Aug. 11, 2006, now U.S. Pat. No. 7,413,256. U.S. patent application Ser. No. 11/463,962 is a continuation-in-part of U.S. patent application Ser. No. 11/463,953, filed on Aug. 11, 2006, now U.S. Pat. No. 7,464,993. The present application is also a continuation-in-part of U.S. patent application Ser. No. 11/695,672, filed on Apr. 3, 2007, now U.S. Pat. No. 7,396,086. U.S. patent application Ser. No. 11/695,672 is a continuation-in-part of U.S. patent application Ser. No. 11/686,831, filed on Mar. 15, 2007, now U.S. Pat. No. 7,568,770. All of these applications are herein incorporated by reference for all that they contain.

BACKGROUND OF THE INVENTION

The present invention relates to a wear resistant tool for use in mining, milling and excavation. The tool comprises a body and a carbide secured to the tool body by brazing. It is especially related to a braze thickness at a braze joint between the cutting insert and the body of the tool.

U.S. Pat. No. 5,141,289 to Stiffler, which is incorporated by reference for all that it contains, discloses an improved cemented carbide tip is provided for use as the forward end of a cutter bit. The tip is rotationally symmetric about its longitudinal axis and has a rearward end for attachment to a ferrous metal body. The rearward end has an annular rearwardly facing first surface, a second surface located radially inside of and forward of the first surface, and a radially inwardly facing third surface separating the first surface from the second surface, and thereby forming a socket in the rear of the tip. The tip further includes a means for substantially centering the tip about a steel protrusion which is to be brazed into the socket. The means for centering preferably takes the form of bumps extending radially inwardly from the third surface of the tip.

Examples of wear resistant tools from the prior art are disclosed in U.S. Pat. No. 4,941,711 to Stiffler, U.S. Pat. No. 4,893,875 to Lonn et al., U.S. Pat. No. 4,201,421 to Den Besten et al., U.S. Pat. No. 4,547,020 to Ojanen, U.S. Pat. No. 4,216,832 to Stephenson et al., U.S. Pat. No. 3,519,309 to Engle et al., U.S. Pat. No. 2,707,619 to Andersson, and U.S. Pat. No. 2,614,813 to Shepherd, which are all herein incorporated by reference for all they contain.

BRIEF SUMMARY OF THE INVENTION

In one aspect of the present invention, a degradation tool or assembly comprises an inverted conical top face formed into a top end of a tool body, which top face tapers towards a central axis of the tool body. A base end of a carbide bolster is adapted to be brazed to the inverted conical top face. At least one protrusion is formed in the top face and is adapted to control a braze thickness between the top face and the base end.

An impact tip may be bonded to the carbide bolster. The tip may comprise a super hard material bonded to a cemented metal carbide substrate at a non-planar interface. The super hard material may comprise substantially conical geometry with a rounded apex. The impact tip may comprise a diameter larger than a diameter of the carbide bolster to which it is bonded.

The conical top face formed into the top end of the tool body may taper towards the central axis of the tool body at a declined angle of 20-30 degrees. The top end of the tool body may also comprise a bore centered on the central axis and adapted to receive a stem formed in the base end of the carbide bolster. The stem may comprise an outer wall tapering at less than four degrees relative to the central axis.

A braze material disposed intermediate the top face and the base end may comprise a non-uniform thickness. The protrusion extending a distance from the top face may comprise an annular ridge, a segmented ridge, a circular bump, a sinuous bump, or combinations thereof. The protrusion may comprise at least three equally spaced bumps. The top end of the tool body may comprise a diameter greater than a diameter of the base end of the carbide bolster.

In some embodiments, the degradation tool or assembly may be incorporated in drill bits, shear bits, milling machines, indenters, mining degradation assemblies, asphalt degradation assemblies, asphalt bits, trenching machines, fixed cutter drill bits, horizontal drill bits, percussion drill bits, roller cone bits, mining picks, pavement milling picks, trencher picks, auger picks, or combinations thereof.

A plurality of protrusions formed in the inverted conical top face located at the top end of the tool body may be arranged in at least two annular rows and the two rows may be offset from each other. The protrusions formed in at least one row may be generally shorter than the protrusions in the other row. The protrusions may be less than 0.007 inches.

The carbide bolster may comprise a cavity formed in its base end. The inverted conical top face may comprise an annular medial lip protruding into the cavity of the bolster. The lip may comprise a curve facing an annular transition between the base end of the bolster and its cavity. The braze thickness may be increased at the transition. The tool body may be a rotatable shield fitted over a rotary bearing surface.

In another aspect of the invention a degradation tool or assembly has a base end of the carbide bolster being brazed to a tool body having a tapered top face, and with the base end and the top face being separated by a pre-determined distance or gap by one or more protrusions. A peripheral annular lip circumscribes the top face. The bolster comprises an outside edge of the base end that is adapted to be received within the annulus of the peripheral annular lip. The degradation tool also comprises a first corner portion between the base surface and the outside edge, and a second corner portion that joins the top face and peripheral annular lip formed into the top end of the tool, the second corner portion being sized and shaped to be spaced apart from the first corner portion in order to form an additional gap between to the top end of the tool body and the base end of the carbide bolster. The distance or gap between the corner portions may be greater than the predetermined distance or gap between the base and the top face. The gaps between the base end of the bolster and the top end of tool body are filled with a braze material to attach the carbide bolster to the tool body.

The degradation assemblies may be incorporated into fixed cutter drill bit, horizontal drill bit, percussion drill bit, roller cone bit, mining pick, pavement milling pick, trencher pick, auger pick, or combinations thereof.

DETAILED DESCRIPTION OF EXEMPLARY EMBODIMENTS

Figure 1:
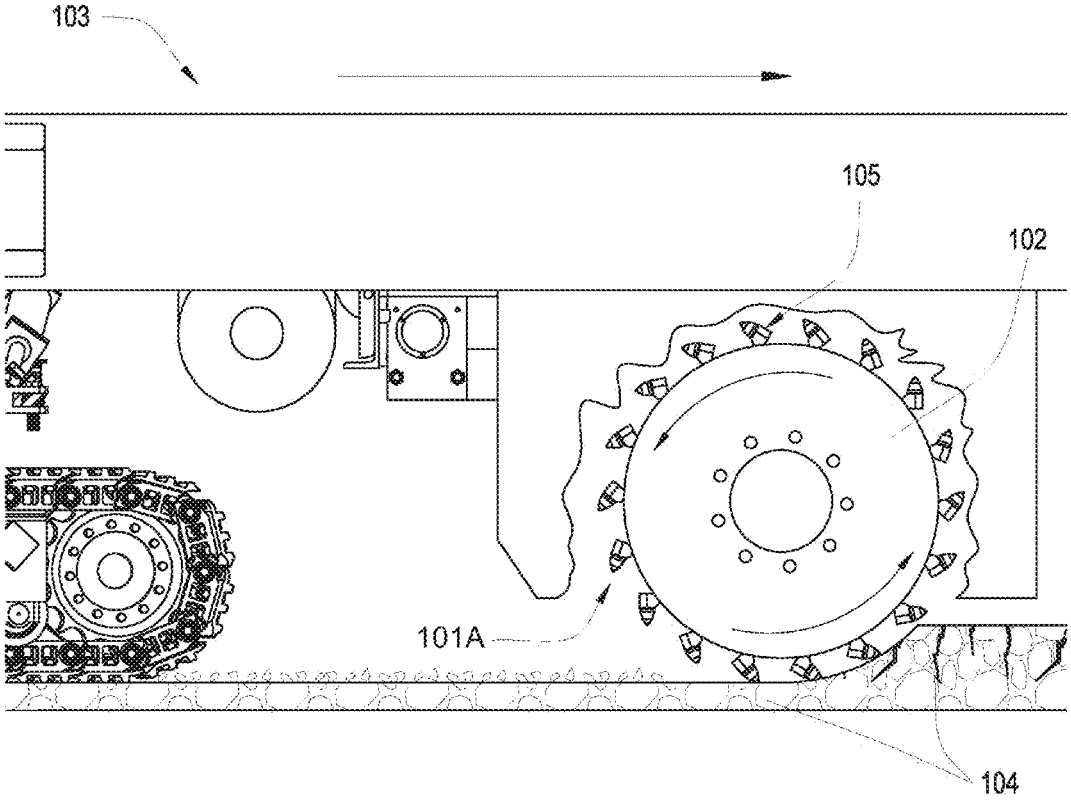
FIG. 1 is a schematic illustration of an embodiment of a plurality of degradation assemblies suspended underside of a pavement milling machine.

FIG. 1 is a schematic illustration that shows a plurality of degradation tools or assemblies 101A attached to a driving mechanism 102, such as a rotatable drum, which is in turn attached to the underside of a pavement milling machine 103. The milling machine 103 may be an asphalt or pavement planer used to degrade man-made formations such as pavement 104 prior to placement of a new layer of pavement. The degradation tools or assemblies 101A may be attached to the drum 102, bringing the degradation tools 101A into engagement with the formation 104. A holder 105, such as a block welded or bolted to the drum, is attached to the driving mechanism 102 and the degradation tool is inserted into the holder. The holder 105 may hold the degradation tool 101A at an angle offset from the direction of rotation, such that the degradation assembly engages the formation 104 at a preferential angle. In some embodiments the shanks of the degradations tools are rotatably disposed within the holders.

Figure 2:
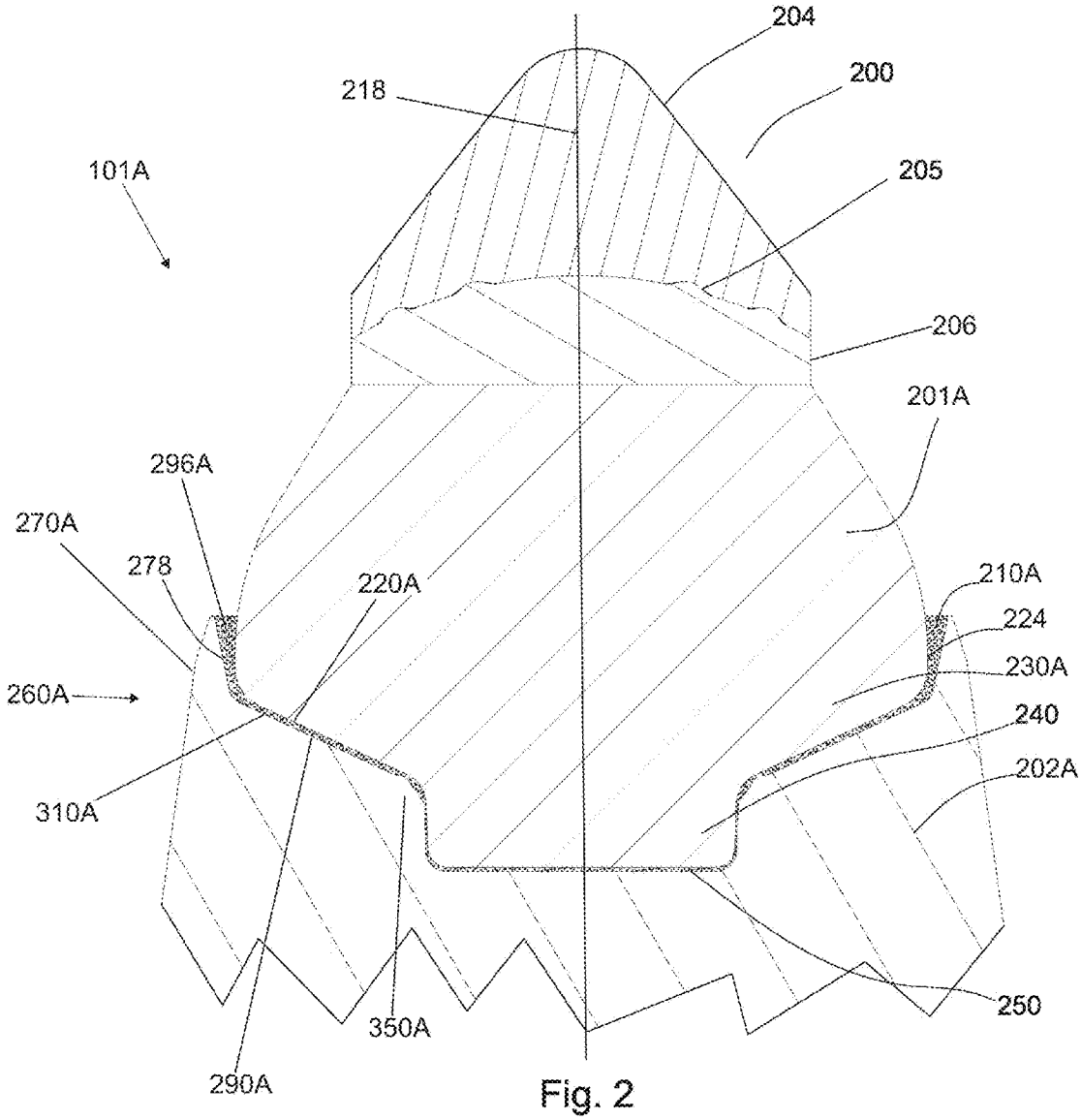
FIG. 2 is a cross-sectional diagram of an embodiment of a degradation assembly.

Referring to FIG. 2, the degradation tool or assembly 101A comprises an impact tip 200, a carbide bolster 201A and a tool body 202A. The impact tip 200 may comprise a super hard material 204 bonded to cemented metal carbide substrate 206 at a non-planar interface 205.

The super hard material 204 may comprise a material selected from a group comprising diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof.

The super hard material 204 may comprise substantially conical geometry with a rounded apex. In some embodiments, the superhard material comprises a thickness of greater than 0.100 inch. In some embodiment of the invention, the superhard material comprises a larger volume than the cemented metal carbide substrate 206 that it is attached to.

The bolster 201 and the tool body 202A are bonded together by brazing. The braze material 210A may comprise silver, gold, copper, nickel, palladium, boron, chromium, silicon, germamum, aluminum, iron, cobalt, manganese, titanium, tin, gallium, vanadium, indium, phosphorus, molybdenum, platinum, zinc, or combinations thereof. The tool body 202A can be made of metal, and may comprise steel, chromium, tungsten, tantalum, niobium, titanium, molybdenum, or metal composites that include carbide, natural diamond, diamond impregnated matrix, silicon bonded diamond, and combinations thereof.

The impact tip 200 may comprise a diameter larger than a diameter of the carbide bolster 201 to which it is bonded. The base end 230A of the carbide bolster 201A may comprise a stem 240 adapted to fit into a bore 250 of the tool body 202A. The stem 240 may resist the shear force developed at a periphery of the top end 260A of the tool body 202A. The stem 240 may comprise an outer wall tapering at less than four degrees.

The top end 260A of the tool body 202A may comprise a diameter that is greater than the diameter of the base end 230A of the carbide bolster 201A. The largest diameter of the carbide bolster 201A may remain secured inside the tool body 202A. The bottom base surface 220A of the bolster 201A may be tapered between 50 and 30 degrees relative to the horizontal plane of FIG. 2 (or between 40 and 60 degrees as measured between a portion of the central axis 218A orientated toward the carbide bolster and the base surface 220A) and which taper can help buttress the bolster upon impact.

It is believed that by controlling the thickness of the braze material 210A to a predetermined distance, the stresses between the carbide and steel may also be controlled. Milling, mining, trenching and other applications where the degradation assemblies may be used are often subjected to high impact loads which propagate through the entire degradation tool or assembly 101A. It is believed that propagating stress from the relatively stiff carbide to the softer steel at the periphery of the joint may require a larger transition portion, or thickness of the braze joint, which may be accomplished through a thicker braze material towards the periphery than the majority of the joint. The thinner portions of the braze joint also comprise optimal parameters which the protrusions may help control. The angle of the base end of the carbide and the angle of the inverted face of the body may be substantially the same or they may be different in order to increase or decrease the thickness of the braze material towards the periphery.

The base end 230A of the carbide bolster 201A and the top face 310A of the tool body 202A may be separated by a pre-determined distance or gap 290A, as established by one or more protrusions 350A. A peripheral annular lip 270A may circumscribe the face. An outer diameter of the bolster may be received with an annulus formed by the peripheral lip 270A. A first corner portion 224 may be formed at the base end 230A between the largest outer diameter of the bolster and the bottom base surface 220A. A second corner portion 278 may be formed between the peripheral lip 270A and the inverted top face 310A formed into the top end 260A of the tool body 202A. The spaces between the base surface bolster and the steel body may be filled with the braze material. The distance or gap 296A between the corner portions 224, 278 may be greater than the pre-determined distance 290A between the top face 310A and base surface 220A established by the one or more protrusions 310A. In some embodiments, the largest diameter of the bolster 201A is below the top of the peripheral lip 270A. The lip 270A may comprise a triangular cross-section. The distance or gap 296A between the base end 230A of the bolster 201A and peripheral lip 270A may increase approaching the top of the lip.

Figure 3:
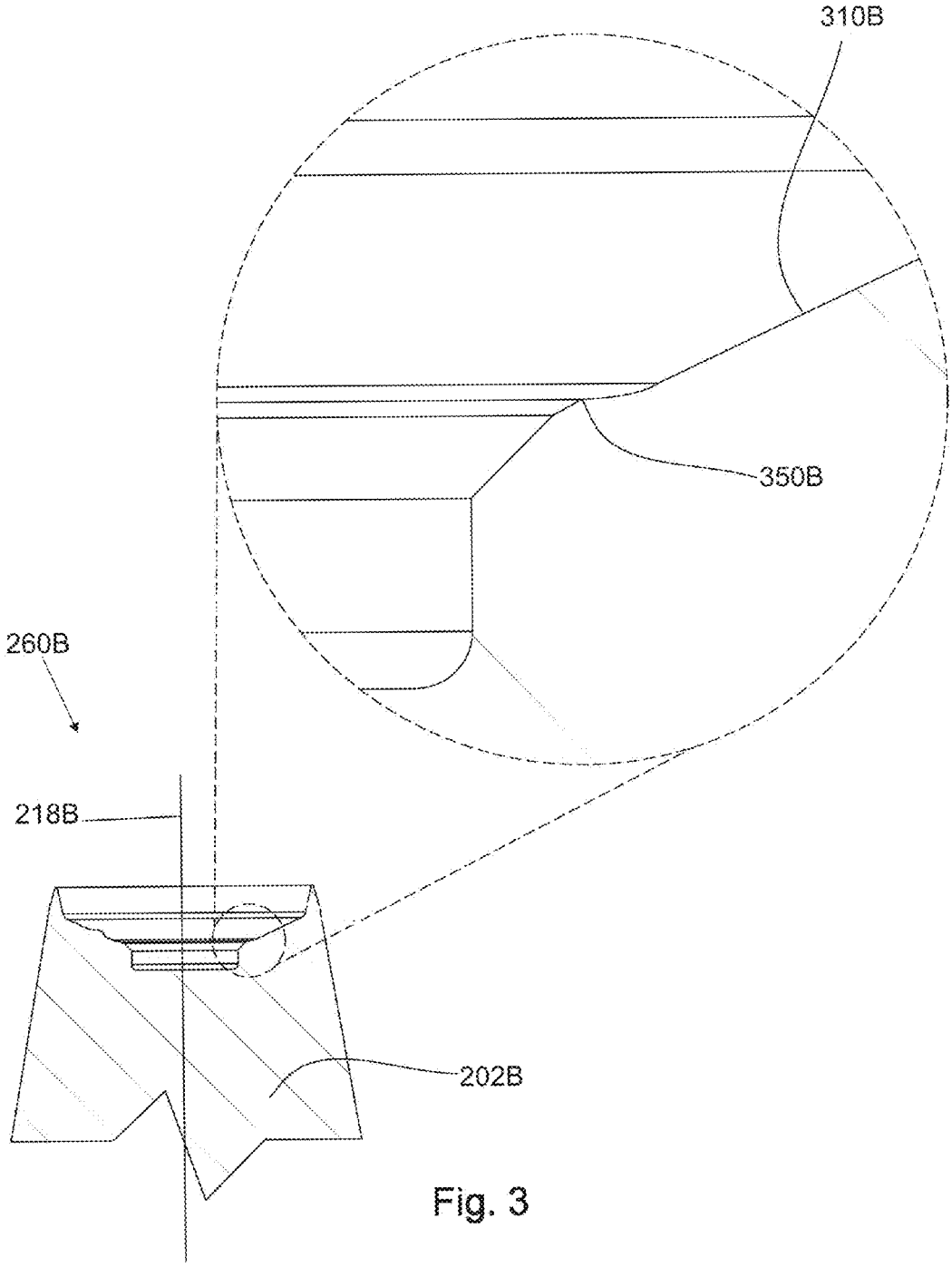
FIG. 3 is a cross-sectional diagram of the top end of the tool body of an embodiment of the degradation assembly.

FIG. 3 is a cross-sectional diagram of the top end 260B of a tool body 202B of another embodiment of the degradation tool or assembly. A top end 260B of the tool body 202B comprises an inverted conical top face 310B tapering towards the central axis 218B of the tool body 202B. The inverted conical top face 310B may be tapered at a declined angle of 20-30 degrees relative to the horizontal plane of FIG. 3 (or between 70 and 60 degrees as measured between a portion of the central axis 218B orientated toward the carbide bolster and the top face 310B). A preferred angle of declination is 25 degrees. A protrusion 350B is formed on the surface of the conical face 310B. The protrusion 350B may comprise a height of 0.002 to 0.007 inches.

Figure 4:
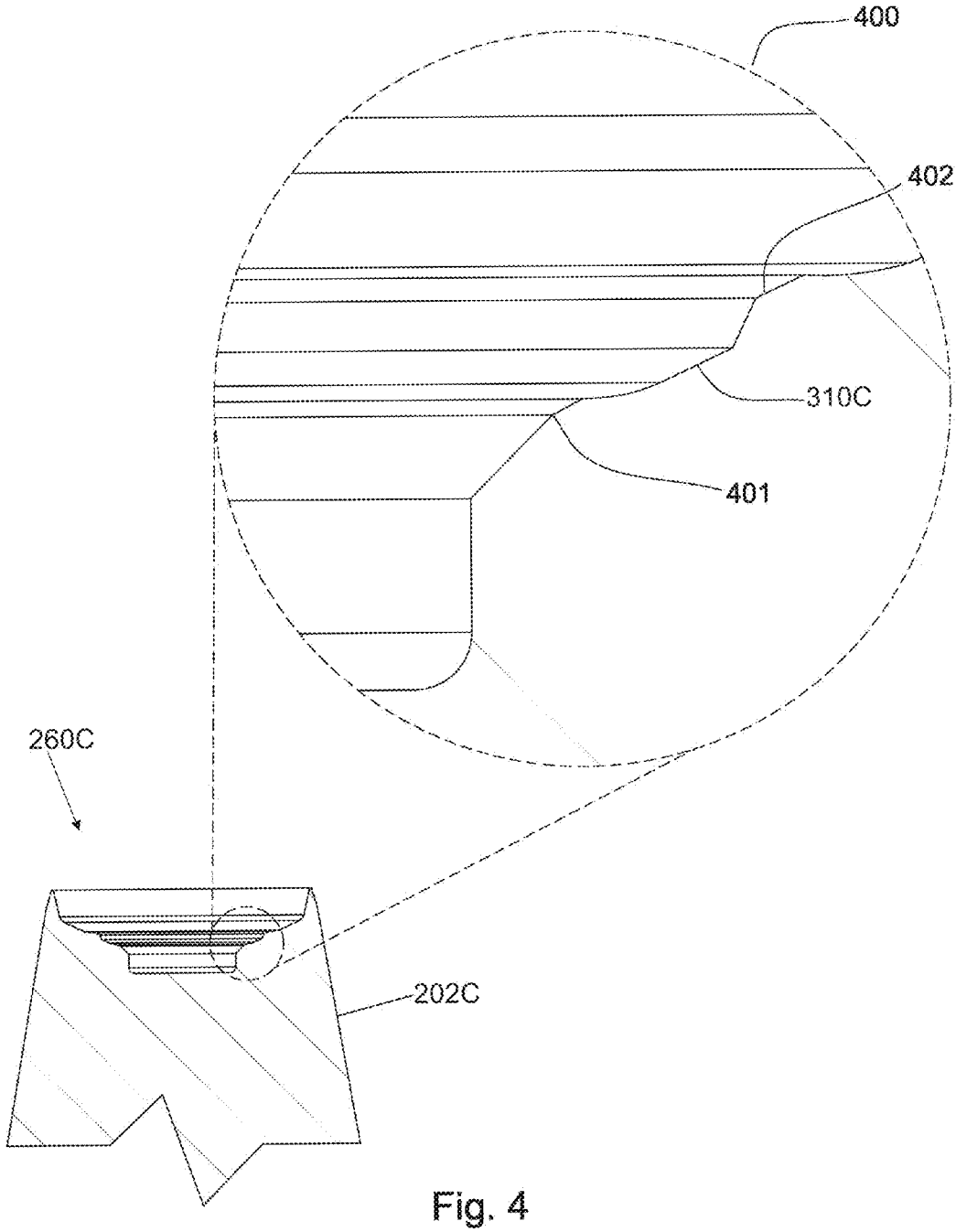
FIG. 4 is a cross-sectional diagram of the top end of the tool body of another embodiment of the degradation assembly.

FIG. 4 is a cross-sectional diagram of the top end 260C of a tool body 202C of another embodiment of the degradation tool or assembly. The inverted conical top face 310C of the tool body 202C may comprise a double protrusion 400. The double protrusion may comprise a first ridge 401 and a second ridge 402. The second ridge 402 may lie just above the first ridge 401. The double ridge 400 may provide an additional support to control the braze thickness. The first ridge 401 and the second ridge 402 may comprise different heights relative to the conical top face 310C.

Figure 5:
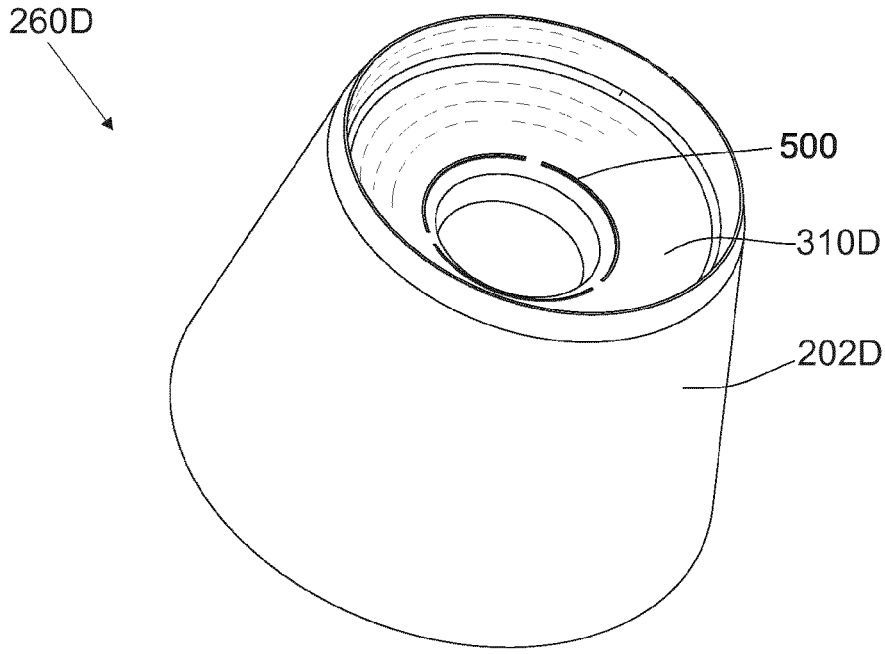
FIG. 5 is a perspective diagram of the top end of the tool body of another embodiment of the degradation assembly.

FIG. 5 is a perspective diagram of the top end 260D of a tool body 202D of another embodiment of the degradation tool or assembly. The inverted conical top face 310D of the tool body 202D may comprise another embodiment of a protrusion in the form of arcuate ridges 500. The arcuate ridges 500 may comprise at least three equally spaced segments. The ridges 500 and a gap between the top end 260D of the tool body 202D and the base end of the carbide bolster may control the flow of the braze material while they are being brazed together.

Figure 6:
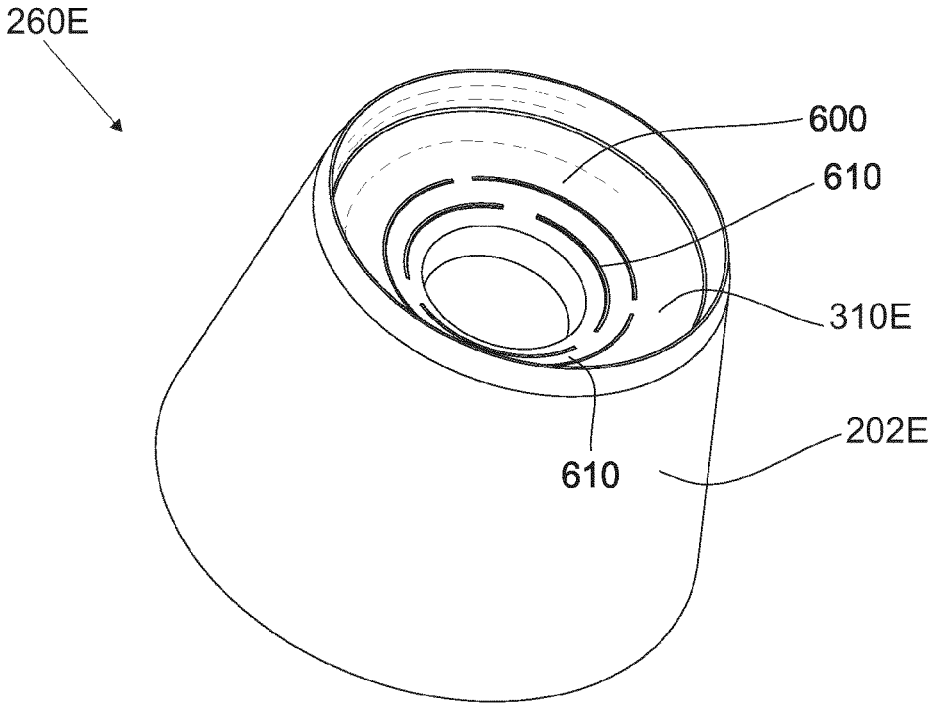
FIG. 6 is a perspective diagram of the top end of the tool body of another embodiment of the degradation assembly.

FIG. 6 is a perspective diagram of the top end 260E of a tool body 202E of another embodiment of the degradation tool or assembly. The inverted conical top face 310E of the tool body 202E may comprise double arcuate ridges 600. Each ridge may be equally spaced. The ridges 600 may comprise over lapping segments 610. The ridges 600 are offset from each other and may comprise different heights.

Figure 7:
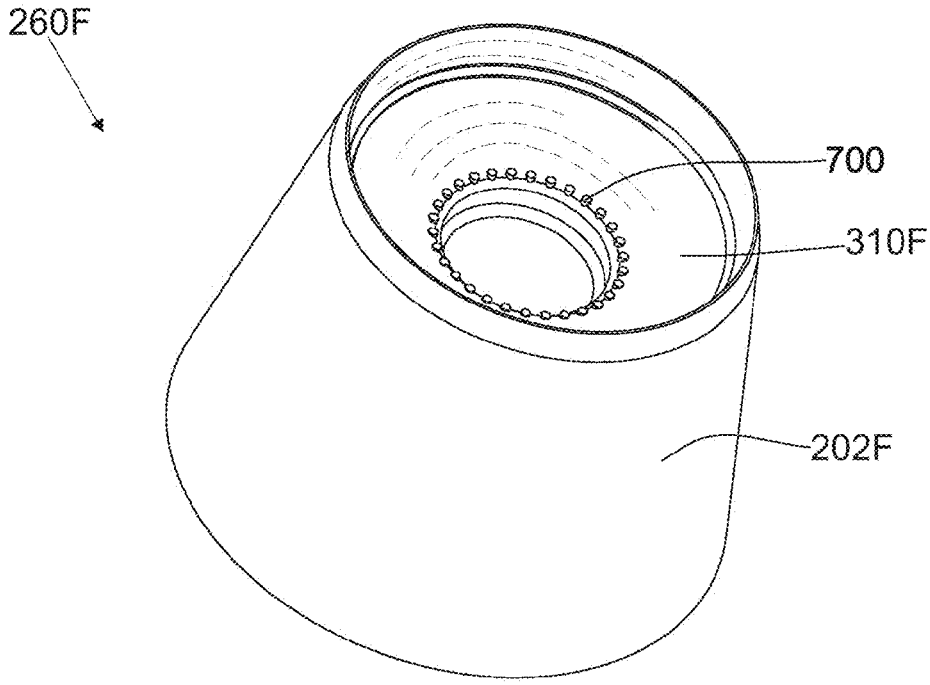
FIG. 7 is a perspective diagram of the top end of the tool body of another embodiment of the degradation assembly.

FIG. 7 is a perspective diagram of the top end 260F of a tool body 202F of another embodiment of the degradation tool or assembly. The inverted conical top face 310F of the tool body 202F may comprise a row of circular bumps 700. The spherical shape bumps 700 may comprise a height of 0.002-0.007 inches.

Figure 8:
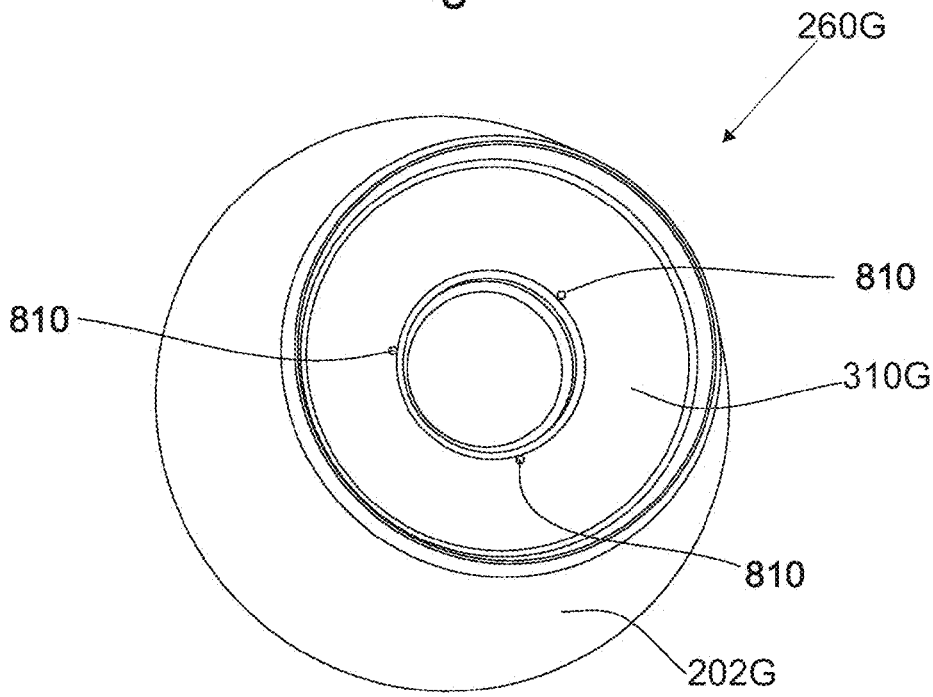
FIG. 8 is a perspective diagram of the top end of the tool body of another embodiment of the degradation assembly.

FIG. 8 is discloses the top end 260G of a tool body 202G of another embodiment of the degradation tool or assembly 101G. The inverted conical top face 310G of the tool body 202G may comprise at least three equally spaced bumps 810 located at 120 degrees to each other.

Figure 9:
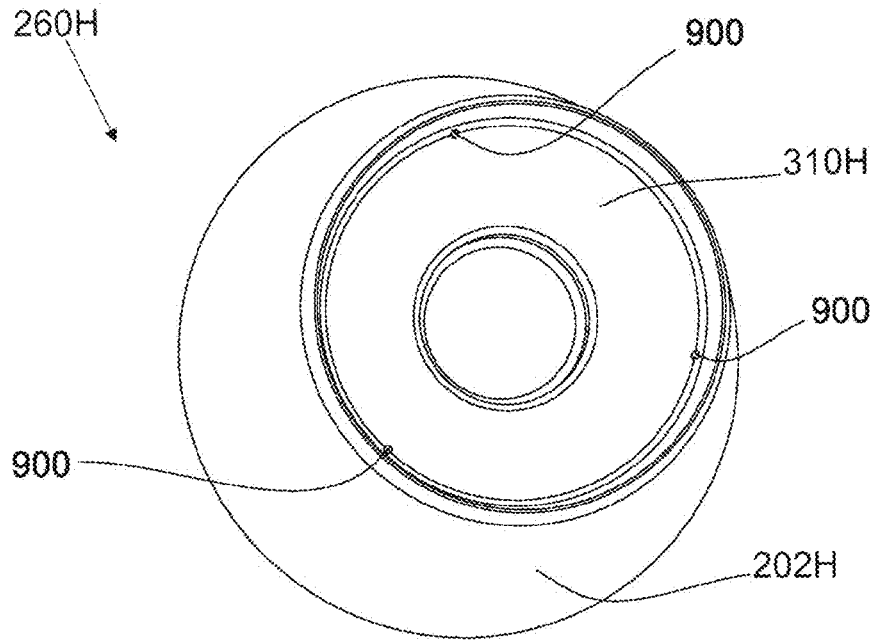
FIG. 9 is a perspective diagram of the top end of the tool body of another embodiment of the degradation assembly.

FIG. 9 discloses the top end 260H of the tool body 202H of another embodiment of the degradation tool or assembly. The inverted conical top face 310H of the tool body 202H may comprise three equally spaced bumps 900 near the periphery of the tool body 202H.

Figure 10:
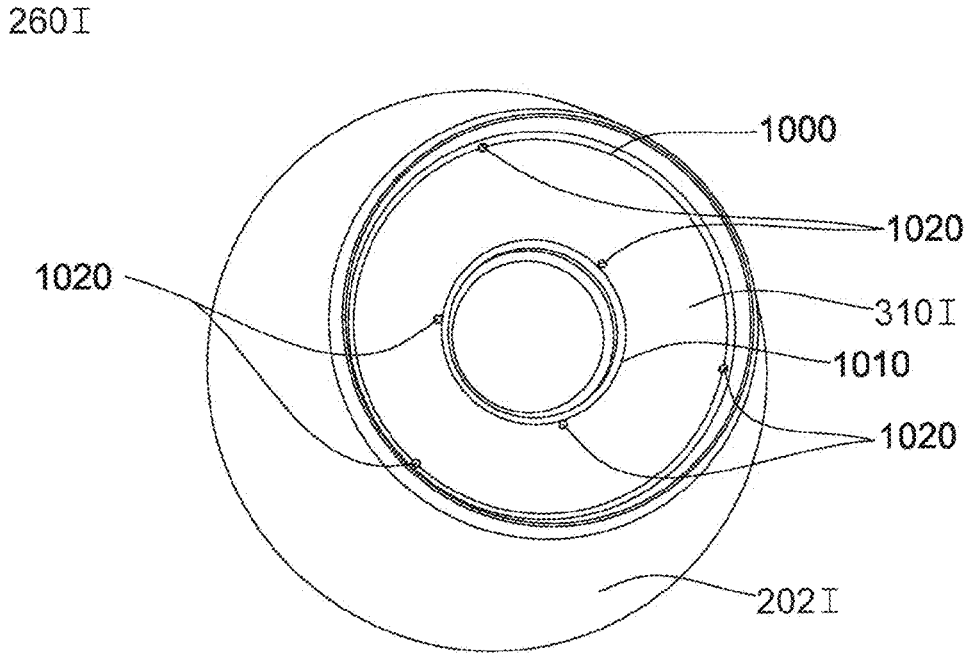
FIG. 10 is a perspective diagram of the top end of the tool body of another embodiment of the degradation assembly.

FIG. 10 is a perspective diagram of the top end 260I of the tool body 202I another embodiment of the degradation tool or assembly. The inverted conical top face 310I of the tool body 202I may comprise two annular rows 1000, 1010 of circular bumps 1020 to control the braze joint thickness. Each row may comprise at least three equally spaced bumps 1020. The bumps 1020 in the rows 1000, 1010 may comprise an alternating configuration.

Figure 11:
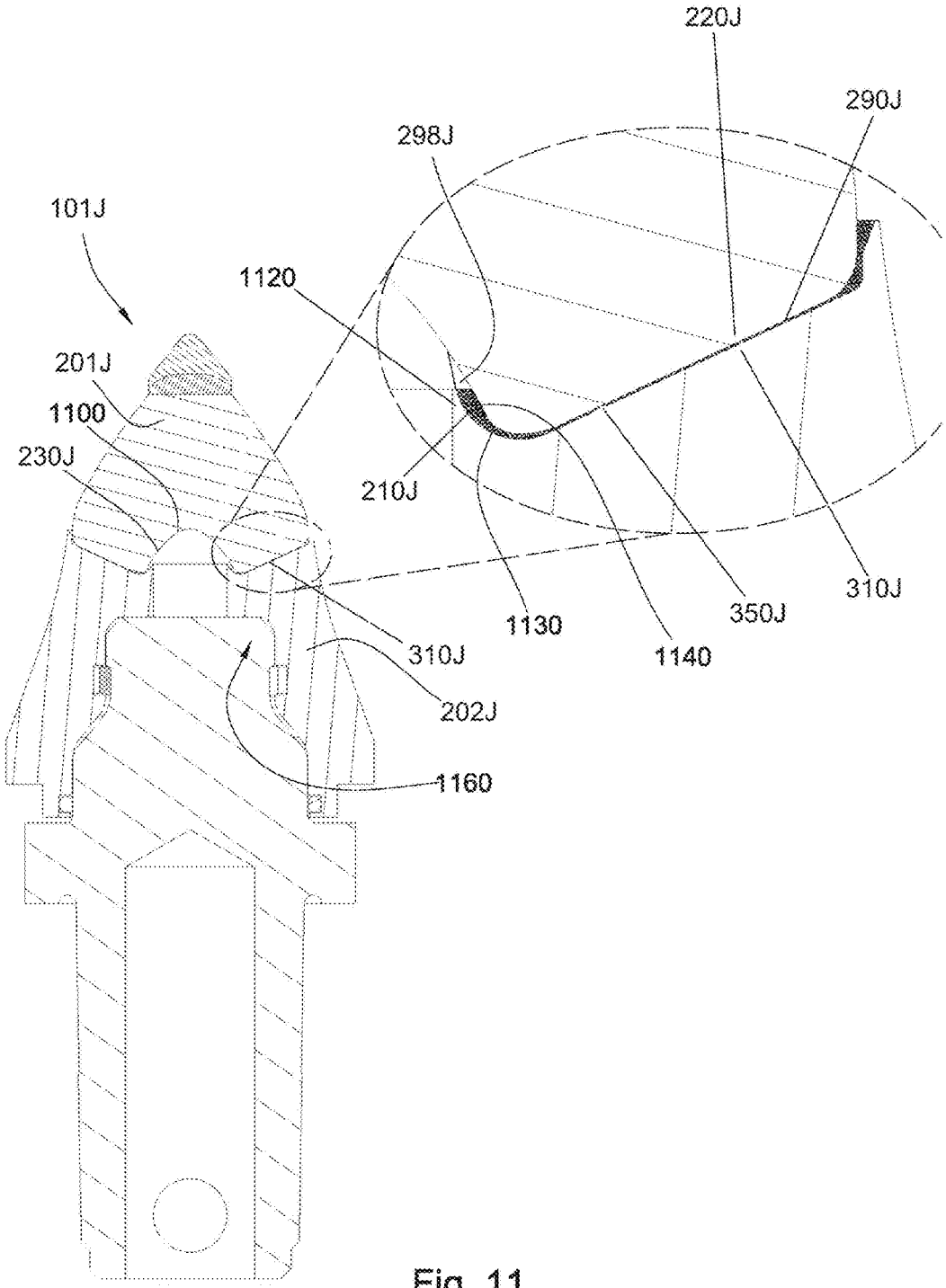
FIG. 11 is a cross-sectional diagram of another embodiment of the degradation assembly.

FIG. 11 is a cross-sectional diagram of an embodiment of the degradation tool or assembly 101J. The degradation assembly 101J may comprise a cavity 1100 formed in the base end 230J of the carbide bolster 201J. The inverted conical top face 310J may comprise a medial annular lip 1120 protruding into the cavity 1100 of the bolster 201J. The lip 1120 may help prevent braze entering a rotary bearing 1160 while brazing. A third corner portion 1130 may exist between the top face 310J and the medial lip 1120 which faces a fourth corner portion 1140 between the base surface 220J of the bolster 201J and its cavity 1100. The distance or gap 298J between the third and fourth corner portions may be greater than the pre-determined distance 290J between the base surface 220J and the top face 310J established by the one or more protrusions 350J. The braze thickness may increase between the corner portions 1130, 1140 for stress reduction. All corners portions preferably have radiuses. The braze material 210J may not reach to a top end of the medial lip 1120. The tool body 202J may rotate over a rotary bearing surface.

Figure 12:
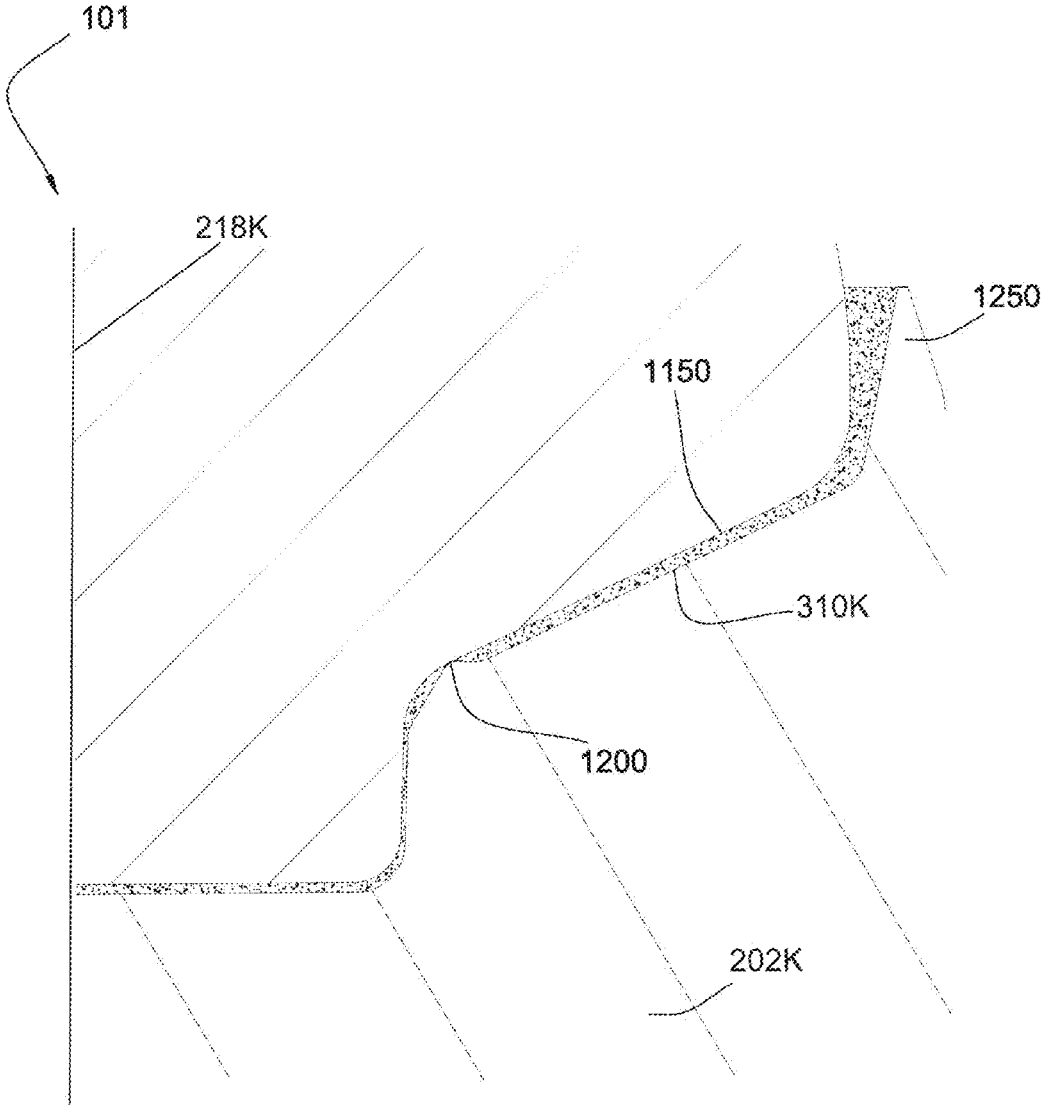
FIG. 12 is a cross-sectional diagram of the braze joint of another embodiment of the degradation assembly.

FIG. 12 discloses the inverted conical face 310K of the tool body 202K with a protrusion 1200. The protrusion 1200 is believed to control the braze thickness 1150. The brazed joint may comprise non-uniform thicknesses. The braze thickness 1150 may increase towards the periphery of the tool body 202K. The braze thickness 1150 may be general thinner near the central axis 218K of the body 202K and largest near the periphery of the body 202K. The larger braze thickness near the periphery of the tool body 202K may provide a thicker transition between the relatively stiffer carbide and the more elastic steel of the tool body and thereby reducing stress between during brazing and protecting the thin steel edge 1250.

Figure 13:
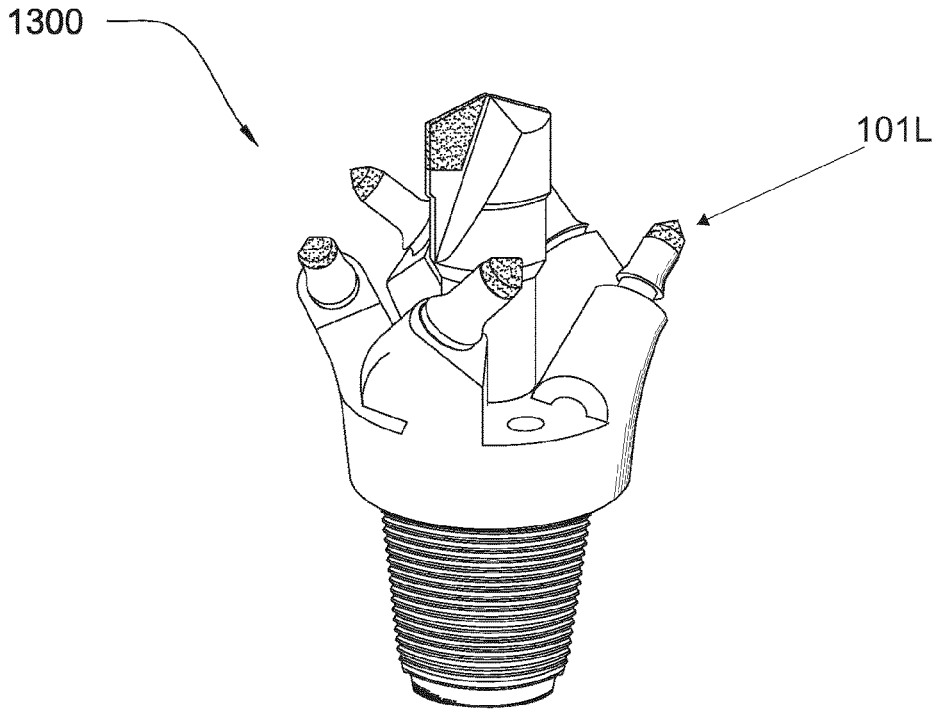
FIG. 13 is a perspective diagram of an embodiment of a drill bit.

Various wear applications that may be incorporated with the present invention, and it is to be appreciated that the present invention may be incorporated in drill bits, shear bits, milling machines, indenters, mining degradation assemblies, asphalt bits, asphalt degradation assemblies, trenching machines, or combinations thereof. For example, FIG. 13 discloses the degradation tool or assembly 101L being installed into a drill bit 1300 typically used in water well drilling.

Figure 14:
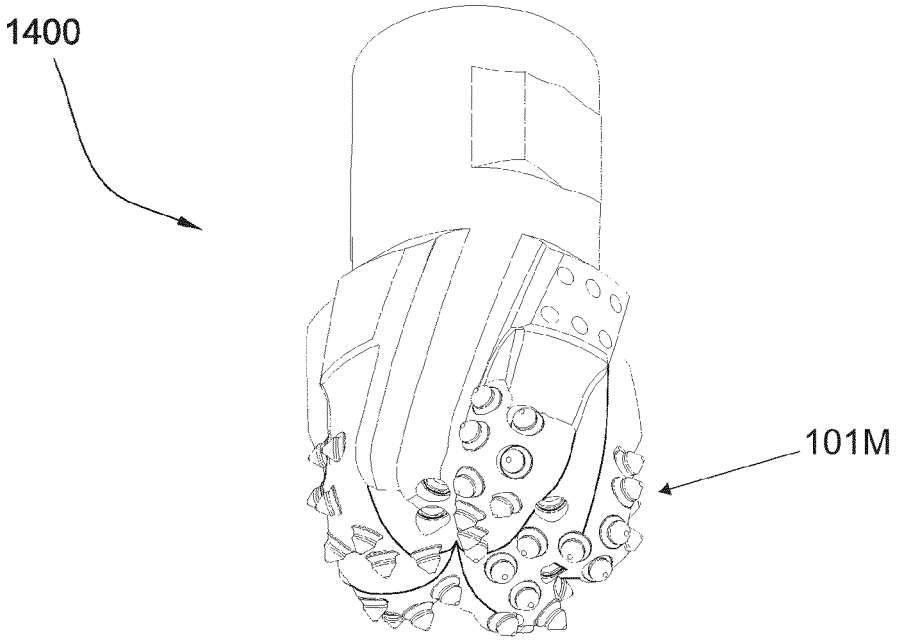
FIG. 14 is a perspective diagram of another embodiment of a drill bit.

The degradation tool or assembly 101M may also be incorporated into a drill bit for use in oil and gas drilling, such as the drag bit 1400 disclosed in FIG. 14.

Figure 15:
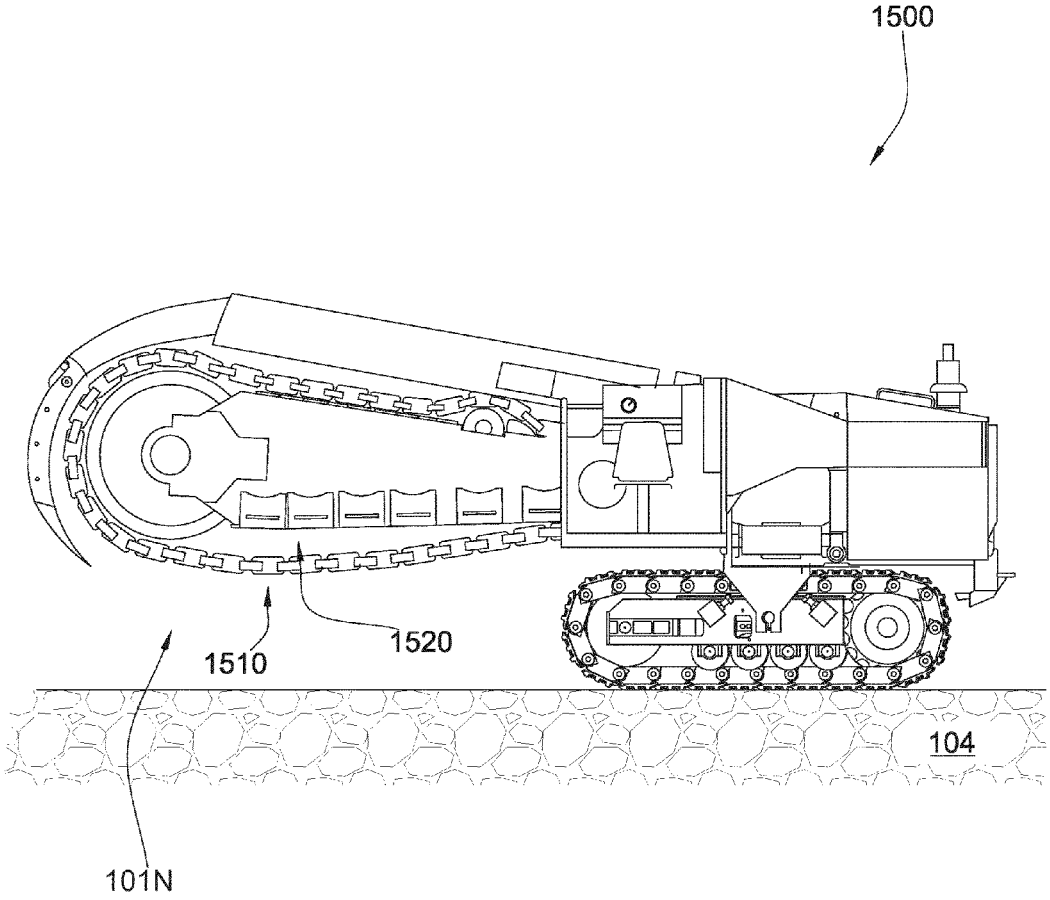
FIG. 15 is an orthogonal diagram of an embodiment of a trenching machine.

FIG. 15 is a perspective diagram of an embodiment of a chain trenching machine 1500. The degradation tools or assemblies 101N may be placed on a chain 1510 that rotates around an arm 1520 of a chain trenching machine 1500.

Figure 16:
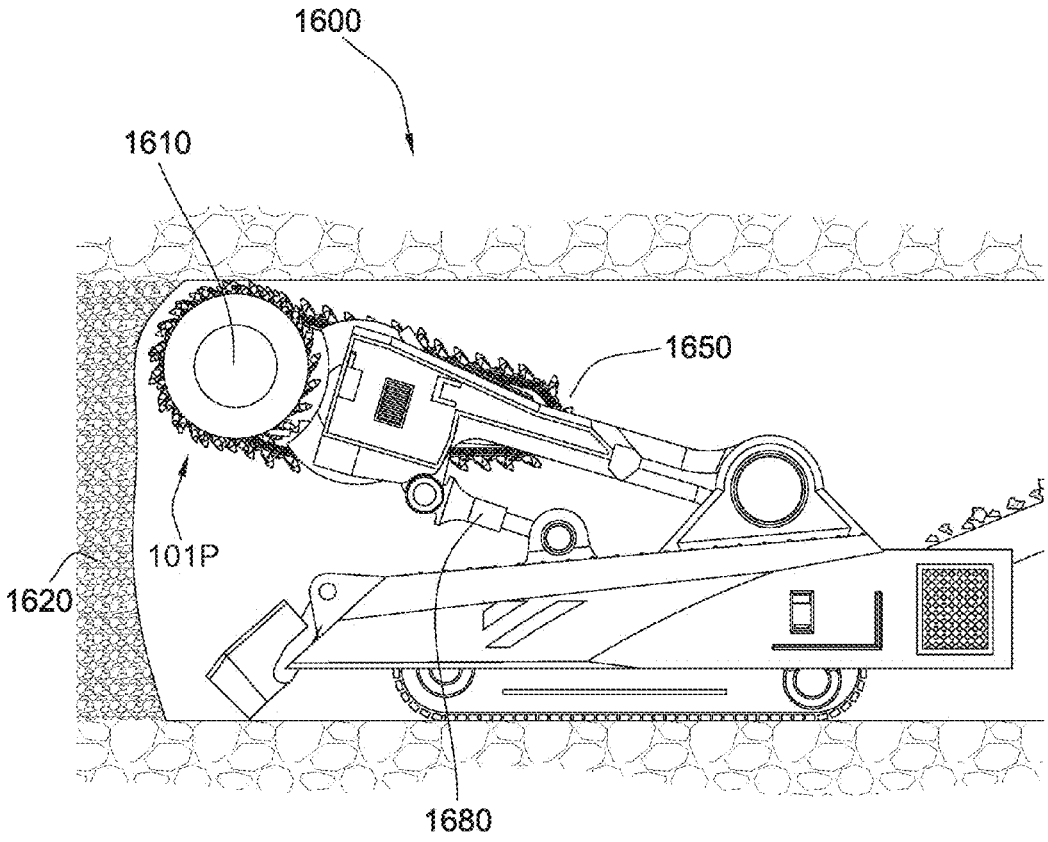
FIG. 16 is an orthogonal diagram of an embodiment of a coal excavator.

FIG. 16 is an orthogonal diagram of an embodiment of a coal excavator 1600. The degradation assemblies 101P may be connected to a rotating drum 1610 that is degrading the coal 1620. The rotating drum 1610 is connected to an arm 1650 that moves the drum 1610 vertically in order to engage the coal 1620. The arm 1650 may move by a hydraulic arm 1680, it may also pivot about an axis or a combination thereof. The coal excavator 1600 may move about by tracks, wheels, or a combination thereof. The coal excavator 1600 may also move about in a subterranean formation. The coal trencher 1600 may be in a rectangular shape providing for easy mobility about the formation.

Whereas the present invention has been described in particular relation to the drawings attached hereto, it should be understood that other and further modifications apart from those shown or suggested herein, may be made within the scope and spirit of the present invention.

What is claimed is:

1. A degradation tool for use in a machine for degrading a formation, the degradation tool comprising:

a carbide bolster having a working end and a base end, the base end having a base surface and a cavity formed in the base surface, the base surface having an outside edge and an inside edge, the inside edge being positioned proximate the cavity;

a tool body having a top end positioned proximate the base end, the top end including:

a top face having at least one protrusion for contacting the base surface, the protrusion extending a distance away from the top face to form a first gap sized to receive braze material, a bore formed in the top face, the bore being proximate the cavity, the top face having an outer lip spaced apart from the outside edge to form a second gap to receive braze material, the second gap being larger than the first gap, and the top face having an inner lip spaced apart from the inside edge to form a third gap to receive braze material, the third gap being larger than the first gap; and a braze material disposed in the first gap, the second gap and the third gap.

2. The degradation tool of claim 1, wherein an impact tip is attached to the working end of the carbide bolster, the impact tip comprising a super hard material bonded to a cemented metal carbide substrate at an interface, the interface being non-planar.

3. The degradation tool of claim 2, wherein the super hard material comprises a substantially conical geometry, the substantially conical geometry having a rounded apex.

4. The degradation tool of claim 1, wherein the degradation tool has a central axis, and wherein the top face is positioned to intersect the central axis at a declined, acute angle of 60-70 degrees as measured between the top face and a portion of the central axis orientated toward the carbide bolster, to form an inverted conical face.

5. The degradation tool of claim 1, wherein the braze material disposed in the first gap comprises a non-uniform thickness.

6. The degradation tool of claim 1, wherein the at least one protrusion is an annular ridge.

7. The degradation tool of claim 1, wherein the at least one protrusion comprises at least three protrusions equally spaced about the face.

8. The degradation tool of claim 1, wherein the degradation tool is incorporated in drill bits, shear bits, milling machines, indenters, mining degradation assemblies, asphalt degradation assemblies, asphalt bits, and trenching machines.

9. The degradation tool of claim 4, wherein a plurality of protrusions formed in the inverted conical face are arranged in at least two annular rows, the two annular rows being angularly offset from each other.

10. The degradation tool of claim 9, wherein the protrusions formed in at least one row are shorter than the protrusions in the other row.

11. The degradation tool of claim 1, wherein the protrusions are less than 0.007 inches.

12. The degradation tool of claim 1, wherein the tool body is a rotatable shield fitted over a rotary bearing surface.

13. A degradation tool for use in a machine for degrading a formation, said degradation tool comprising:

a carbide bolster having a working end and a base end, said base end having a base surface and a cavity formed in said base surface, said base surface having an outside edge and an inside edge proximate said cavity;

a tip for impacting said formation, said tip being attached to said working end;

a tool body having a top end positioned proximate said base end, said top end including:

a top face having at least one protrusion for contacting said base surface, said protrusion extending a distance above said top face to form a first gap for braze material between said top face and said base surface, a bore formed in said top face, said bore being proximate said cavity, said top face having an outer lip spaced apart from said outside edge to form a second gap for braze material, said second gap being larger than said first gap, and said top face having an inner lip spaced apart from said inside edge to form a third gap for braze material, said third gap being larger than said first gap; and a braze material positioned in said first gap, said second gap and said third gap.

14. The degradation tool of claim 13, comprising said degradation tool having a central axis and said base surface being angled relative to said central axis from said outside edge to said inside edge.

15. The degradation tool of claim 14, comprising said top face being angled relative to said central axis from said outer lip to said inner lip.

16. The degradation tool of claim 15, wherein said top face forms an inverted conical face.

17. A degradation tool for use in a machine for degrading a formation, said degradation tool comprising:

a carbide bolster having a working end and a base end, said base end having an outside surface, a base surface, and a cavity formed in said base surface, said cavity having an inside surface;

a tip for impacting said formation, said tip being attached to said working end;

a tool body having a top end positioned proximate said base end, said top end including a top face proximate said base surface and a bore proximate said cavity, said top face having:

at least one protrusion for contacting said base surface, said protrusion extending a distance above said top face to form a first gap for braze material between said top face and said base surface, a peripheral lip spaced apart from said outside surface to form a second gap for braze material, said second gap being larger than said first gap, and a medial lip spaced apart from said inside surface to form a third gap for braze material, said third gap being larger than said first gap; and a braze material positioned in said first gap, said second gap and said third gap.

18. The degradation tool of claim 17, comprising said degradation tool having a central axis and said base surface being angled relative to said central axis from said outside edge to said inside edge.

19. The degradation tool of claim 18, comprising said top face being angled relative to said central axis from said outer lip to said inner lip to substantially align with said base surface.

20. The degradation tool of claim 18, comprising said top face being angled relative to said central axis from said outer lip to said inner lip at a declined angle of 60-70 degrees relative to said central axis to form an inverted conical face.

* * * * *